US007012383B2

(12) United States Patent
Lin

(10) Patent No.: US 7,012,383 B2
(45) Date of Patent: Mar. 14, 2006

(54) DIGITAL-DIMMING CONTROL METHOD AND MODULE FOR DIMMING OPERATION OF A COLD CATHODE FLUORESCENT LAMP

(75) Inventor: Chang-Hua Lin, Taipei Hsien (TW)

(73) Assignee: St. John's University, Taipei (TW)

( * ) Notice: Subject to any disclaimer, the term of this patent is extended or adjusted under 35 U.S.C. 154(b) by 0 days.

(21) Appl. No.: 10/842,946

(22) Filed: May 10, 2004

(65) Prior Publication Data

US 2005/0127847 A1 Jun. 16, 2005

(30) Foreign Application Priority Data

Dec. 10, 2003 (TW) ..... 92134855 A

(51) Int. Cl.
*G05F 1/00* (2006.01)

(52) U.S. Cl. ..... 315/291; 315/DIG. 4; 315/224

(58) Field of Classification Search ..... 315/291, 315/DIG. 4, 307, 224
See application file for complete search history.

(56) References Cited

U.S. PATENT DOCUMENTS

| | | | | |
|---|---|---|---|---|
| 6,677,710 | B1 * | 1/2004 | Weedon | 315/77 |
| 6,788,006 | B1 * | 9/2004 | Yamamoto | 315/219 |
| 2002/0014865 | A1 * | 2/2002 | Akimoto et al. | 315/291 |
| 2003/0062848 | A1 * | 4/2003 | Prasad | 315/224 |
| 2003/0222593 | A1 * | 12/2003 | Yamamoto | 315/219 |
| 2004/0178746 | A1 * | 9/2004 | Nemirow | 315/291 |

FOREIGN PATENT DOCUMENTS

GB 2211636 A * 10/1988

* cited by examiner

*Primary Examiner*—Wilson Lee
*Assistant Examiner*—Angela M Lie
(74) *Attorney, Agent, or Firm*—Ostrolenk, Faber, Gerb & Soffen, LLP

(57) ABSTRACT

A method for dimming operation of a lamp includes the steps of generating a trapezoidal wave signal in response to an input square wave low frequency dimming gating signal, and generating a driving signal that has a low frequency when the trapezoidal wave signal has a low level, that has a high frequency when the trapezoidal wave signal has a high level, that shifts gradually from the low frequency to the high frequency when the trapezoidal wave signal goes from the low level to the high level, and that shifts gradually from the high frequency to the low frequency when the trapezoidal wave signal goes from the high level to the low level. A module that performs the method is also disclosed.

20 Claims, 7 Drawing Sheets

$V_{LFD}$
V
t
$V_{LFD}'$
$I_a$
I
$V_{ds}$
62 kHz
82 kHz
62 kHz
82 kHz
82 kH
62 kHz

DIGITAL-DIMMING CONTROL METHOD AND MODULE FOR DIMMING OPERATION OF A COLD CATHODE FLUORESCENT LAMP

CROSS-REFERENCE TO RELATED APPLICATION

This application claims priority of Taiwanese application no. 092134855, filed on Dec. 10, 2003.

BACKGROUND OF THE INVENTION

1. Field of the Invention

The invention relates to a digital-dimming method and module for dimming operation of a lamp, more particularly to a digital-dimming method and module that eliminates high ignition voltage and high current spikes during lamp operation.

2. Description of the Related Art

A conventional digital-dimming control module controls dimming operation of a cold cathode fluorescent lamp of a liquid crystal display by generating a driving signal that corresponds to the duty cycle of a square wave low frequency dimming gating signal. FIG. 1(A) to 1(C) illustrate a voltage ($V_L$) across and a current ($I_L$) through the cold cathode fluorescent lamp.

Although the conventional digital-dimming control module achieves its intended purpose, since the square wave low frequency signal ($V_{LFD}$) varies abruptly between low and high voltage levels, the cold cathode fluorescent lamp is struck repeatedly with high ignition voltage ($V_P$) and high current spikes ($I_P$) during the dimming operation. This significantly shortens the service life of the cold cathode fluorescent lamp.

SUMMARY OF THE INVENTION

Therefore, the object of the present invention is to provide a digital-dimming control method and module that eliminates high ignition voltage and high current spikes during lamp operation.

According to one aspect of the present invention, a digital-dimming control method for dimming operation of a lamp comprises the steps of:

(A) generating a trapezoidal wave voltage signal in response to an input square wave low frequency dimming gating signal;

(B) generating a trapezoidal wave current signal that corresponds to the trapezoidal wave voltage signal and that varies between first and second current levels; and (C) generating a driving signal that controls activation and deactivation of the lamp, the driving signal having a first frequency when the trapezoidal wave current signal has the first current level and having a second frequency when the trapezoidal wave current signal has the second current level, the driving signal shifting gradually from the first frequency to the second frequency when the trapezoidal wave current signal goes from the first current level to the second current level and shifting gradually from the second frequency to the first frequency when the trapezoidal wave current signal goes from the second current level to the first current level.

According to another aspect of the present invention, a digital-dimming control module for dimming operation of a lamp comprises a slew rate limiter, a voltage-controlled current source, and a variable frequency oscillator. The slew rate limiter is adapted to receive a square wave low frequency dimming gating signal, and is operable so as to generate a trapezoidal wave voltage signal in response to the low frequency dimming gating signal. The voltage-controlled current source is coupled to the slew rate limiter, and is operable so as to generate a trapezoidal wave current signal that corresponds to the trapezoidal wave voltage signal and that varies between first and second current levels. The variable frequency oscillator is coupled to the voltage-controlled current source, and is operable so as to generate a driving signal for controlling activation and deactivation of the lamp. The driving signal has a first frequency when the trapezoidal wave current signal has the first current level, and has a second frequency when the trapezoidal wave current signal has the second current level. The driving signal shifts gradually from the first frequency to the second frequency when the trapezoidal wave current signal goes from the first current level to the second current level, and shifts gradually from the second frequency to the first frequency when the trapezoidal wave current signal goes from the second current level to the first current level.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figures 1A, 1B, 1C:
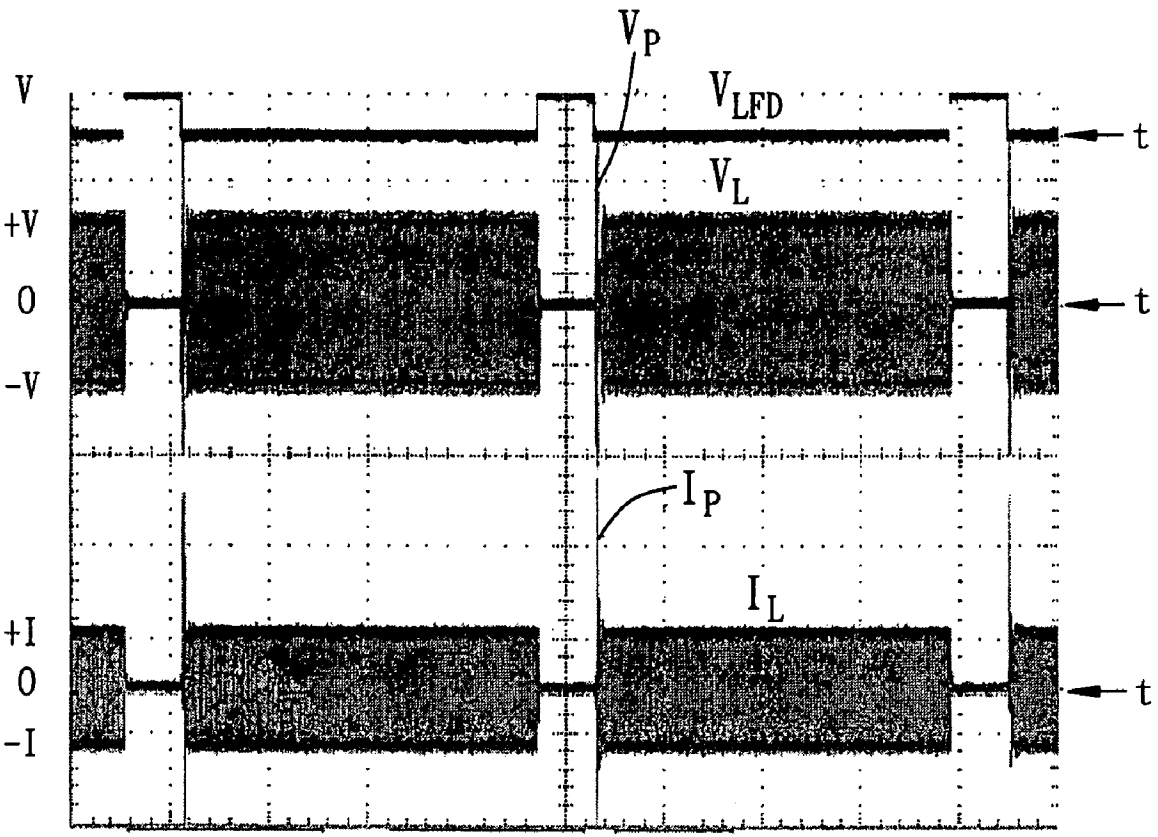
FIG. 1(A) PRIOR ART
FIG. 1(B) PRIOR ART
FIG. 1(C) PRIOR ART
FIG. 1(A) to 1(C) are time charts to illustrate voltage and current output responses ($V_L$, $I_L$) of a conventional digital-dimming control module to a square wave low frequency dimming gating signal ($V_{LFD}$)
Figure 2:
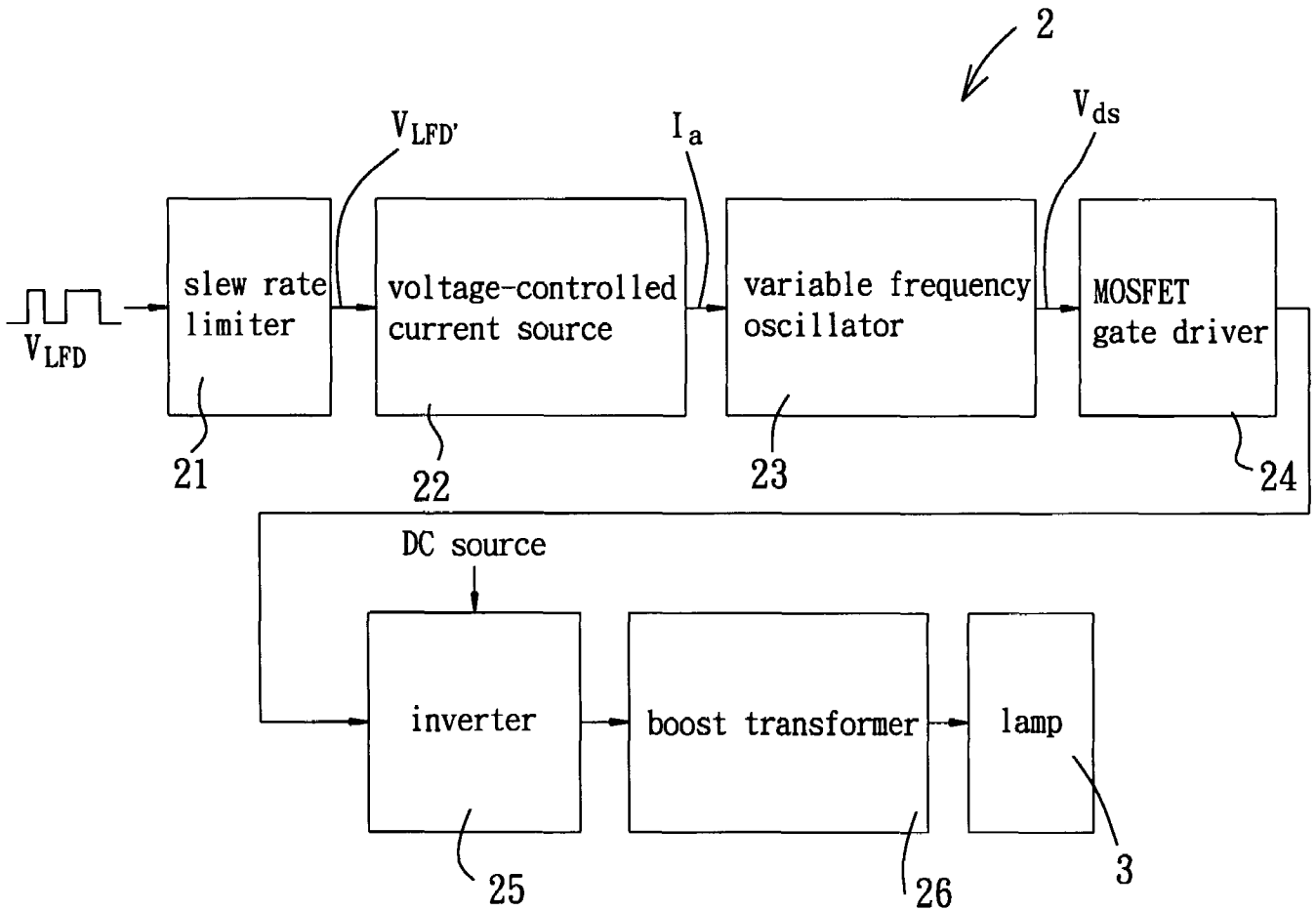
FIG. 2 is a schematic circuit block diagram of the preferred embodiment of a digital-dimming control module for dimming operation of a lamp according to the present invention.
Figure 3:
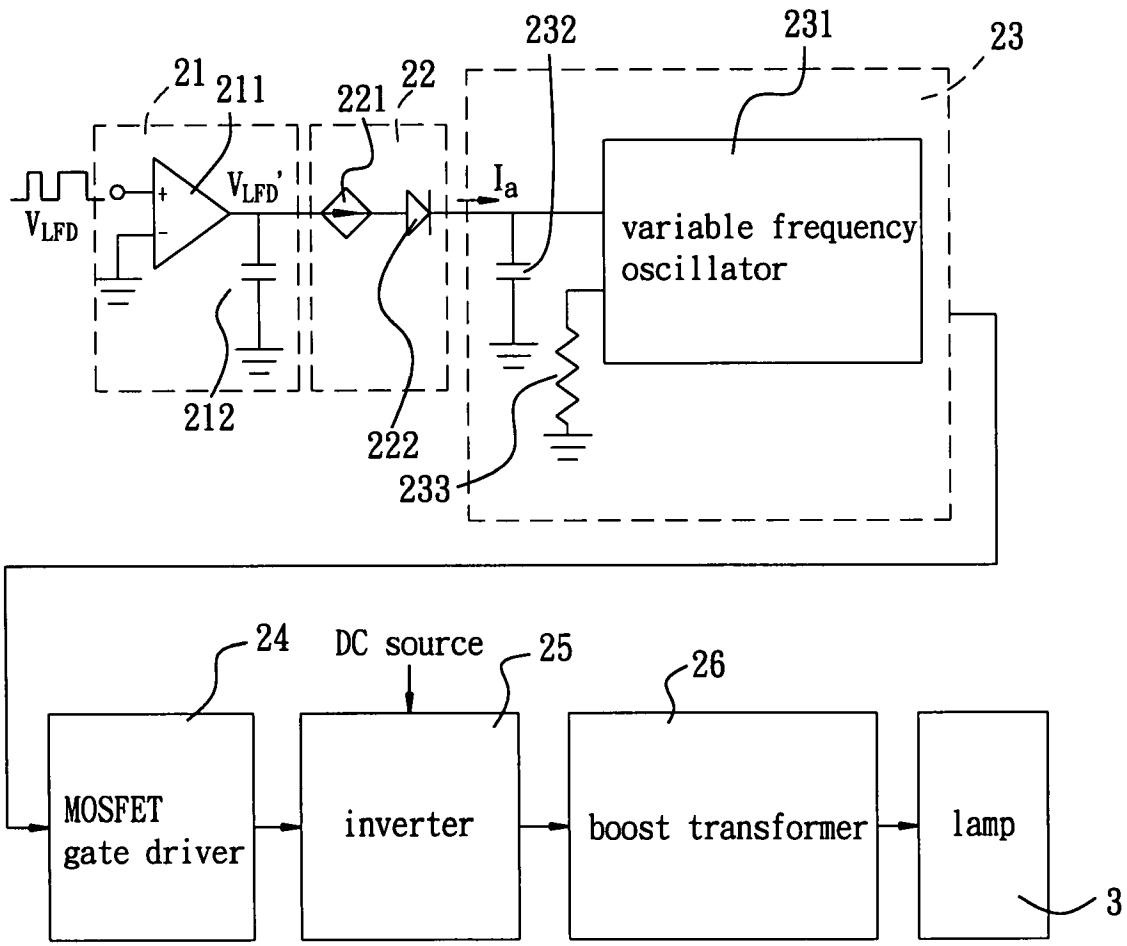
FIG. 3 is a diagram similar to FIG. 2 but illustrating circuit components of a slew rate limiter, a voltage-controlled current source, and a variable frequency oscillator of the preferred embodiment.

Referring to FIGS. 2 and 3, the preferred embodiment of a digital-dimming control module 2 according to the present invention is shown to include a slew rate limiter 21, a voltage-controlled current source 22, and a variable frequency oscillator 23.

The digital-dimming control module 2 is adapted to control dimming operation of a lamp 3, such as a cold cathode fluorescent lamp, in a manner to be described hereinafter.

Figures 5A, 5B, 5C, 5D:
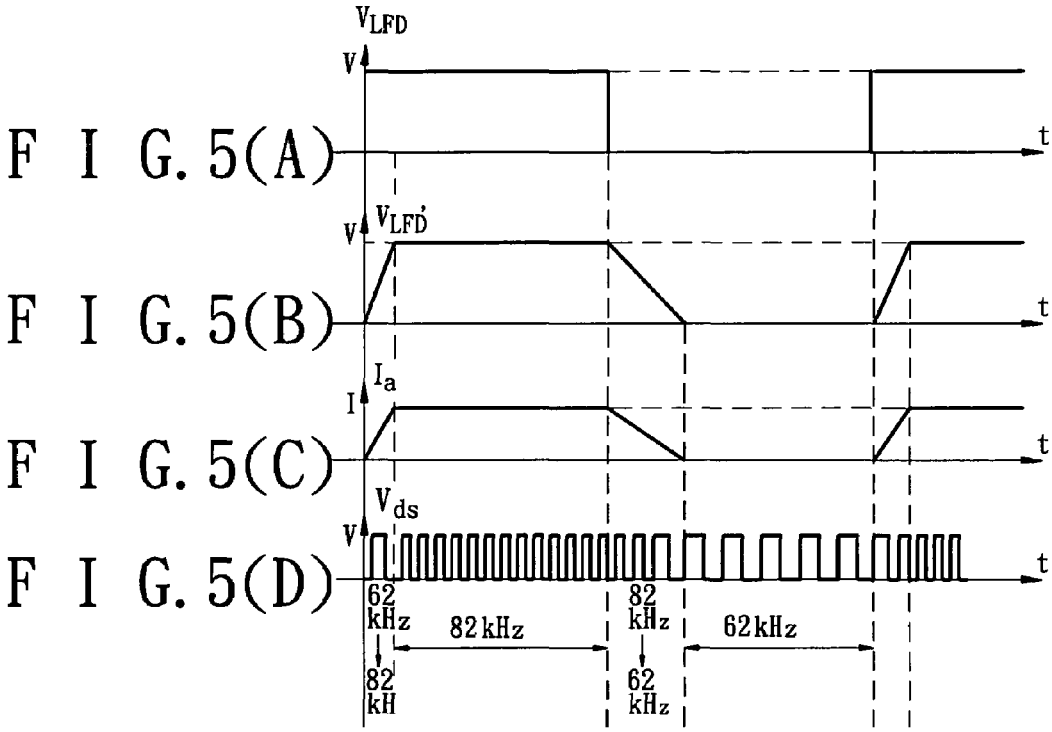
FIG. 5(A) to 5(D) are time charts to illustrate the relation among a square wave low frequency dimming gating signal ($V_{LFD}$), a trapezoidal wave voltage signal ($V_{LFD}'$), a trapezoidal wave current signal ($I_a$), and a driving signal ($V_{ds}$)

The slew rate limiter 21 has an input side that is adapted to receive a square wave low frequency dimming gating signal ($V_{LFD}$), and an output side. As shown in FIG. 5(A), the square wave low frequency dimming gating signal ($V_{LFD}$) varies between low and high voltage levels, and has steep rising and falling edges. In this embodiment, the slew rate limiter 21 is operable so as to generate a trapezoidal wave voltage signal ($V_{LFD}'$) in response to the low frequency dimming gating signal ($V_{LFD}$). As shown in FIG 5(B), the trapezoidal wave voltage signal ($V_{LFD}'$) varies between low and high voltage levels, and has sloping rising and falling edges. The slew rate limiter 21 includes an operational amplifier 211 and a capacitor 212, as shown in FIG. 3. The operational amplifier 211 of the slew rate limiter 21 has a non-inverting input terminal that serves as the input side of the slew rate limiter 21, a grounded inverting input terminal, and an output terminal that serves as the output side of the slew rate limiter 21. The capacitor 212 has a first terminal connected to the output terminal of the operational amplifier 211 of the slew rate limiter 21, and a grounded second terminal.

Figure 4:
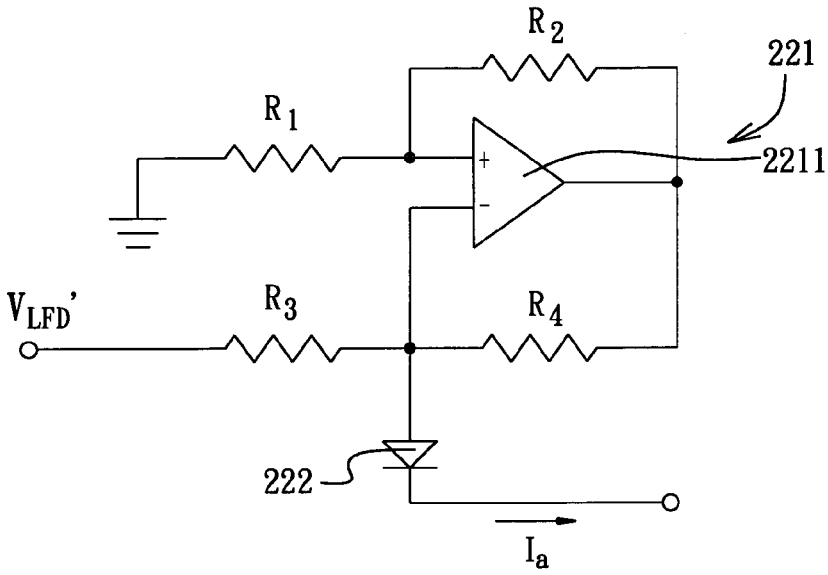
FIG. 4 is a schematic circuit diagram of a negative impedance converter of the voltage-controlled current source.

The voltage-controlled current source 22 has an input side that is connected to the output side of the slew rate limiter 21, and an output side. In this embodiment, the voltage-controlled current source 22 is operable so as to generate a trapezoidal wave current signal ($I_a$) that corresponds to the trapezoidal wave voltage signal ($V_{LFD}'$). As shown in FIG. 5(C), the trapezoidal wave current signal ($I_a$) varies between low and high current levels, and has sloping rising and falling edges. The voltage-controlled current source 22 includes a negative impedance converter 221 and a diode 222. As shown in FIG. 4, the negative impedance converter 221 includes an operational amplifier 2211 and resistors (R1, R2, R3, R4). The operational amplifier 2211 of the negative impedance converter 221 has inverting input and non-inverting input terminals, and an output terminal. The resistor (R1) has a first terminal connected to the non-inverting input terminal of the operational amplifier 2211 of the negative impedance converter 221, and a grounded second terminal. The resistor (R2) has first and second terminals respectively connected to the non-inverting input terminal and the output terminal of the operational amplifier 2211 of the negative impedance converter 221. The resistor (R3) has a first terminal connected to the inverting input terminal of the operational amplifier 2211 of the negative impedance converter 221, and a second terminal that serves as the input side of the voltage-controlled current source 22. The resistor (R4) has first and second terminals respectively connected to the inverting input terminal and the output terminal of the operational amplifier 2211 of the negative impedance converter 221. The diode 222 has an anode terminal connected to the output terminal of the operational amplifier 2211 of the negative impedance converter 221 via the resistor (R4), and a cathode terminal that serves as the output side of the voltage-controlled current source 22.

The variable frequency oscillator 23 has an input side that is connected to the output side of the voltage-controlled current source 22, and an output side In this embodiment, the variable frequency oscillator 23 is operable so as to generate a driving signal ($V_{ds}$) that corresponds to the trapezoidal wave current signal ($I_a$). As shown in FIG. 5(D), the driving signal ($V_{ds}$) varies between a low frequency, such as 62 KHz, and a high frequency, such as 82 KHz. The variable frequency oscillator 23 includes an oscillator circuit 231, a capacitor 232, and a resistor 233. The oscillator circuit 231 has first and second terminals that serve as the input and output sides of the variable frequency oscillator 23, respectively. The capacitor 232 has a first terminal coupled to the first terminal of the oscillator circuit 231, and a grounded second terminal. The resistor 233 has a first terminal connected to the oscillator circuit 231, and a grounded second terminal. The resistor 233 cooperates with the capacitor 233 so as to define a time constant of the oscillator circuit 231.

It is noted that the high frequency corresponds to a cutoff frequency of the lamp 3, and the low frequency corresponds to an operating frequency of the lamp 3. In other words, the lamp 3 is deactivated when the driving signal ($V_{ds}$) has the high frequency, and is activated when the driving signal ($V_{ds}$) has the low frequency.

The digital-dimming control module further comprises a gate driver 24, specifically a MOSFET gate driver, coupled to the output side of the variable frequency oscillator 23, an inverter 25 coupled to the gate driver 24, a direct current source coupled to the inverter 25, and a boost transformer 26 adapted to couple the inverter 25 to the lamp 3. The boost transformer 26 generates a sinusoidal voltage signal that corresponds to the driving signal ($V_{ds}$) of the variable frequency oscillator 23, in a manner well known in the art. Since the specific configuration of the gate driver 24, the inverter 25, and the boost transformer 26 are not pertinent to the present invention, a detailed description thereof is omitted herein for the sake of brevity.

In this embodiment, the oscillator circuit 231 of the variable frequency oscillator 23 and the gate driver 24 are implemented in separate integrated circuits. The capacitor 232 and the resistor 233 are externally coupled to the oscillator circuit 231. In an alternative embodiment, the oscillator circuit 231 of the variable frequency oscillator 23 and the gate driver 24 are implemented in a single integrated circuit.

The driving signal ($V_{ds}$) response of the variable frequency oscillator is described hereinafter with reference to FIGS. 5(A) to 5(D).

When the square wave low frequency dimming gating signal ($V_{LFD}$) has the low voltage level, the trapezoidal wave voltage signal ($V_{LFD}'$) has the low voltage level, while the trapezoidal wave current signal ($I_a$) has the low current level. At this time, the driving signal ($V_{ds}$) has the low frequency. Accordingly, the lamp 3 is activated.

When the square wave low frequency dimming gating signal ($V_{LFD}$) goes from the low voltage level to the high voltage level, the trapezoidal wave voltage signal ($V_{LFD}'$) gradually increases from the low voltage level to the high voltage level, while the trapezoidal wave current signal ($I_a$) gradually increases from the low current level to the high current level. At this time, the driving signal ($V_{ds}$) shifts gradually from the low frequency to the high frequency. Accordingly, the lamp 3 is gradually deactivated.

When the square wave low frequency dimming gating signal ($V_{LFD}$) has the high voltage level, the trapezoidal wave voltage signal ($V_{LFD}'$) has the high voltage level, while the trapezoidal wave current signal ($I_a$) has the high current level. At this time, the high frequency of the driving signal ($V_{ds}$) is maintained. Accordingly, the lamp 3 is deactivated.

When the square wave low frequency dimming gating signal ($V_{LFD}$) goes from the high voltage level back to the low voltage level, the trapezoidal wave voltage signal ($V_{LFD}'$) gradually decreases from the high voltage level to the low voltage level, while the trapezoidal wave current signal ($I_a$) gradually decreases from the high current level to the low current level. At this time, the driving signal ($V_{ds}$) shifts gradually from the high frequency back to the low frequency. Accordingly, the lamp 3 is gradually activated.

Figures 6A, 6B, 6C:
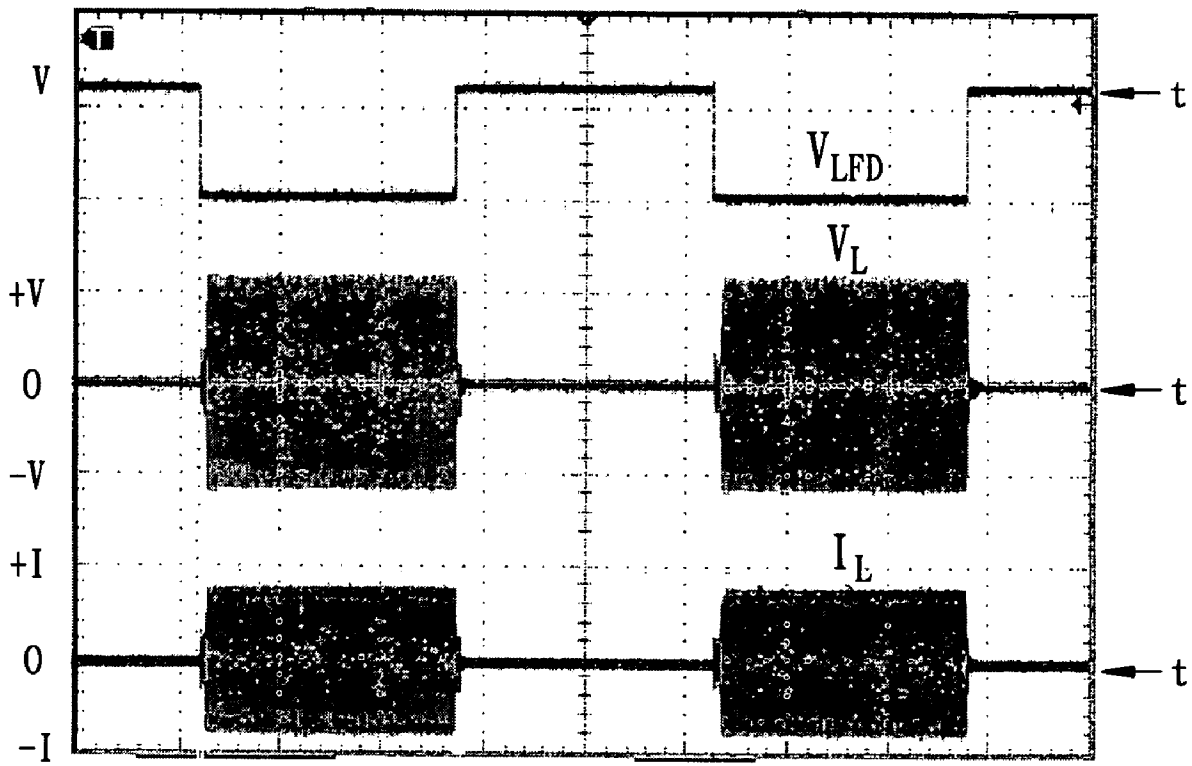
FIG. 6(A) to 6(C) are time charts to illustrate voltage and current output responses ($V_L$, $I_L$) of the preferred embodiment of the digital-dimming control module to the square wave low frequency dimming gating signal ($V_{LFD}$)

From an experimental results, a voltage ($V_L$) across and a current ($I_L$) through the cold cathode fluorescent lamp 3 in response to the square wave low frequency dimming gating signal ($V_{LFD}$) is illustrated in FIGS. 6(A) to 6(C). As shown, the voltage ($V_L$) does not include high ignition voltage, while the current component ($I_L$) does not include high current spikes during the dimming operation. The digital-dimming control module 2 of the present invention indeed eliminates the high ignition voltage and the high current spikes.

Figure 7:
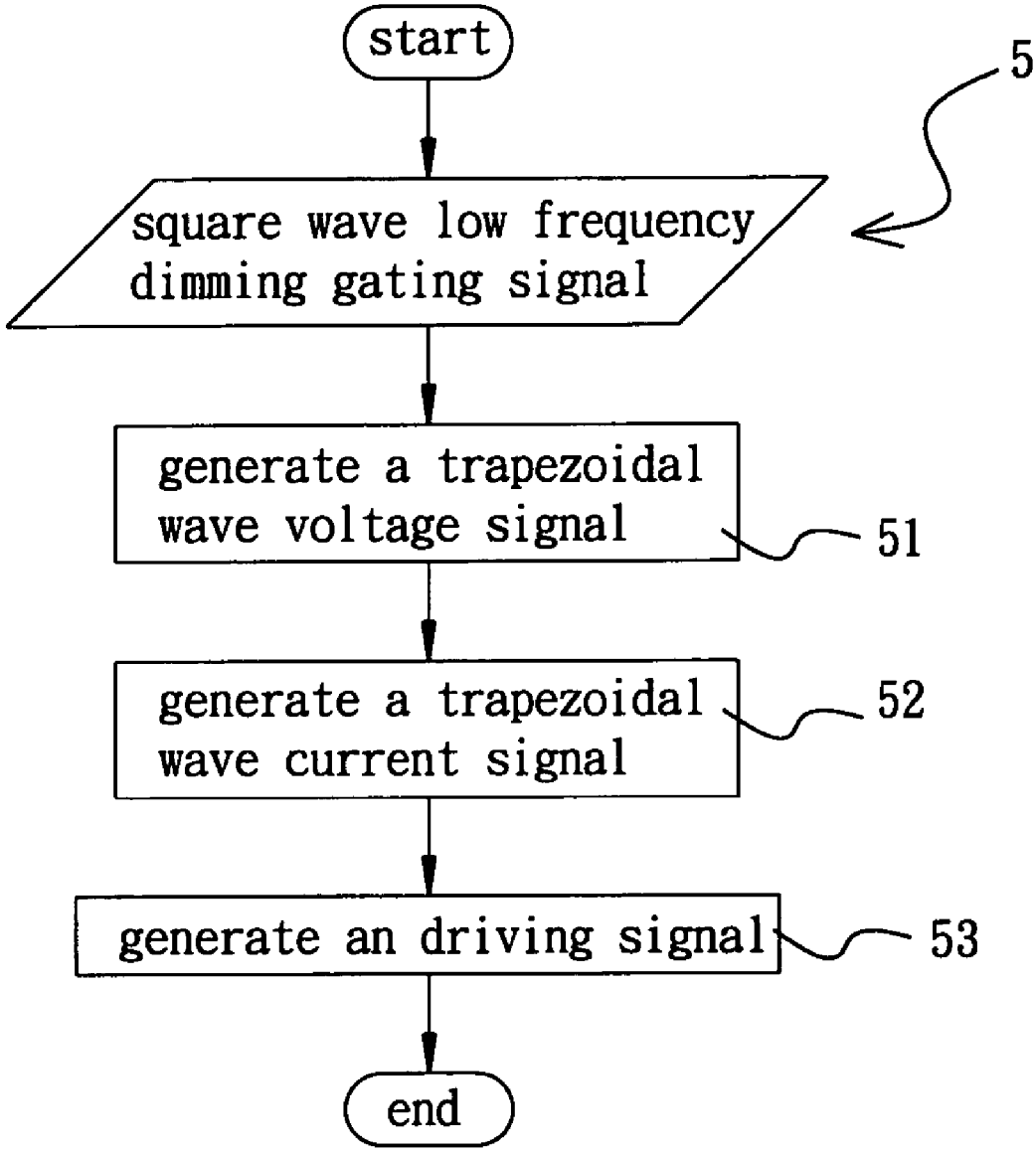
FIG. 7 is a flowchart of the preferred embodiment of a digital-dimming control method for dimming operation of a lamp according to the present invention.

The preferred embodiment of the digital-dimming control method 5 for dimming operation of the lamp 3 according to this invention comprises the steps shown in FIG. 7.

In response to the input square wave low frequency dimming gating signal ($V_{LFD}$), in step 51, the slew rate limiter 21 generates a trapezoidal wave voltage signal ($V_{LFD}'$). Subsequently, the voltage-controlled current source 22 generates a trapezoidal wave current signal ($I_a$) that corresponds to the trapezoidal wave voltage signal ($V_{LFD}'$). Finally, the variable frequency oscillator 23 generates a driving signal ($V_{ds}$) such that the driving signal ($V_{ds}$) has the low frequency when the trapezoidal wave current signal ($I_a$) has the low current level and has the high frequency when the trapezoidal wave current signal ($I_a$) has the high current level, and such that the driving signal ($V_{ds}$) shifts gradually from the low frequency to the high frequency when the trapezoidal wave current signal ($I_a$) goes from the low current level to the high current level and shifts gradually from the high frequency to the low frequency when the trapezoidal wave current signal ($I_a$) goes from the high current level to the low current level.

It has thus been shown that the digital-dimming control module 2 of this invention comprises a slew rate limiter 21 that generates a trapezoidal wave voltage signal ($V_{LFD}'$) in response to a square wave low frequency dimming gating signal ($V_{LFD}$), a voltage-controlled current source 22 that generates a trapezoidal wave current signal ($I_a$) corresponding to the trapezoidal wave voltage signal ($V_{LFD}'$), and a variable frequency oscillator 23 that generates a driving signal ($V_{ds}$) that shifts gradually between low and high frequencies to control gradual activation and deactivation of the lamp 3. Accordingly, high-voltage ignition and high-current spikes are completely eliminated. Furthermore, the digital-dimming control module 2 of this invention is relatively simple to implement, thereby significantly reducing manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A digital-dimming control method for dimming operation of a lamp, comprising the steps of:

(A) generating a trapezoidal wave voltage signal in response to an input square wave low frequency dimming gating signal;

(B) generating a trapezoidal wave current signal that corresponds to the trapezoidal wave voltage signal and that varies between first and second current levels; and (C) generating a driving signal that controls activation and deactivation of the lamp, the driving signal having a first frequency when the trapezoidal wave current signal has the first current level and having a second frequency when the trapezoidal wave current signal has the second current level, the driving signal shifting gradually from the first frequency to the second frequency when the trapezoidal wave current signal goes from the first current level to the second current level and shifting gradually from the second frequency to the first frequency when the trapezoidal wave current signal goes from the second current level to the first current level.

2. The digital-dimming control method as claimed in claim 1, wherein the second current level is higher than the first current level.

3. The digital-dimming control method as claimed in claim 1, wherein the second frequency is higher than the first frequency.

4. The digital-dimming control method as claimed in claim 1, wherein the lamp is deactivated when the driving signal has the second frequency, and is activated when the driving signal has the first frequency.

5. The digital-dimming control method as claimed in claim 1, wherein the second current level is higher than the first current level, and the second frequency is higher than the first frequency.

6. The digital-dimming control method as claimed in claim 5, wherein the second frequency corresponds to a cutoff frequency of the lamp, and the first frequency corresponds to an operating frequency of the lamp.

7. A digital-dimming control module for dimming operation of a lamp, comprising:

a slew rate limiter adapted to receive a square wave low frequency dimming gating signal, and operable so as to generate a trapezoidal wave voltage signal in response to the low frequency dimming gating signal;

a voltage-controlled current source coupled to said slew rate limiter, and operable so as to generate a trapezoidal wave current signal that corresponds to the trapezoidal wave voltage signal and that varies between first and second current levels; and a variable frequency oscillator coupled to said voltage-controlled current source, and operable so as to generate a driving signal for controlling activation and deactivation of the lamp;

wherein the driving signal has a first frequency when the trapezoidal wave current signal has the first current level, and has a second frequency when the trapezoidal wave current signal has the second current level;

wherein the driving signal shifts gradually from the first frequency to the second frequency when the trapezoidal wave current signal goes from the first current level to the second current level, and shifts gradually from the second frequency to the first frequency when the trapezoidal wave current signal goes from the second current level to the first current level.

8. The digital-dimming control module as claimed in claim 7, wherein the second current level is higher than the first current level.

9. The digital-dimming control module as claimed in claim 7, wherein the second frequency is higher than the first frequency.

10. The digital-dimming control module as claimed in claim 7, wherein the lamp is deactivated when the driving signal has the second frequency, and is activated when the driving signal has the first frequency.

11. The digital-dimming control module as claimed in claim 7, wherein the second current level is higher than the first current level, and the second frequency is higher than the first frequency.

12. The digital-dimming control module as claimed in claim 11, wherein the second frequency corresponds to a cutoff frequency of the lamp, and the first frequency corresponds to an operating frequency of the lamp.

13. The digital-dimming control module as claimed in claim 7, wherein said slew rate limiter includes an operational amplifier that receives the low frequency dimming gating signal and that has an output terminal, and a capacitor coupled to said output terminal of said operational amplifier.

14. The digital-dimming control module as claimed in claim 7, wherein said voltage-controlled current source includes a negative impedance converter, and a diode coupled to said negative impedance converter.

15. The digital-dimming control module as claimed in claim 7, further comprising a gate driver coupled to said variable frequency oscillator.

16. The digital-dimming control module as claimed in claim 15, further comprising an inverter coupled to said gate driver, and a direct current source coupled to the inverter.

17. The digital-dimming control module as claimed in claim 16, further comprising a boost transformer adapted to couple said inverter to the lamp.

18. The digital-dimming control module as claimed in claim 17, wherein each of said variable frequency oscillator and said gate driver is implemented in an integrated circuit.

19. The digital-dimming control module as claimed in claim 17, wherein said variable frequency oscillator and said gate driver are implemented in a single integrated circuit chip.

20. The digital dimming control module as claimed in claim 15, wherein said gate driver is a MOSFET gate driver.

* * * * *